US009258658B2

(12) United States Patent
Jørgensen et al.

(10) Patent No.: US 9,258,658 B2
(45) Date of Patent: Feb. 9, 2016

(54) TEST DEVICE FOR A SPEAKER MODULE FOR A LISTENING DEVICE

(71) Applicant: OTICON A/S, Smørum (DK)

(72) Inventors: Ivan H. H. Jørgensen, Smørum (DK); Frank Engel Rasmussen, Smørum (DK)

(73) Assignee: OTICON A/S, Smorum (DK)

( * ) Notice: Subject to any disclaimer, the term of this patent is extended or adjusted under 35 U.S.C. 154(b) by 312 days.

(21) Appl. No.: 13/785,824

(22) Filed: Mar. 5, 2013

(65) Prior Publication Data

US 2013/0251165 A1 Sep. 26, 2013

Related U.S. Application Data

(60) Provisional application No. 61/607,026, filed on Mar. 6, 2012.

(30) Foreign Application Priority Data

Mar. 6, 2012 (EP) ..... 12158242

(51) Int. Cl.
*H04R 29/00* (2006.01)
*H04R 25/00* (2006.01)

(52) U.S. Cl.
CPC ..... *H04R 29/001* (2013.01); *H04R 25/30* (2013.01)

(58) Field of Classification Search
CPC ..... H04R 29/001; H04R 25/30
USPC ..... 381/58, 59, 60
See application file for complete search history.

(56) References Cited

U.S. PATENT DOCUMENTS

| | | | |
|---|---|---|---|
| 5,659,621 | A | 8/1997 | Newton |
| 6,269,318 | B1 | 7/2001 | Geddes |
| 6,712,754 | B2 | 3/2004 | Miller et al. |
| 6,859,538 | B1 | 2/2005 | Voltz |
| 6,934,400 | B1 | 8/2005 | Vonlanthen |
| 7,064,957 | B1 | 6/2006 | Liang et al. |
| 7,286,678 | B1 | 10/2007 | Bachler et al. |
| 8,027,496 | B2 | 9/2011 | Bachler et al. |
| 2002/0015506 | A1 | 2/2002 | Aceti et al. |
| 2002/0026091 | A1 | 2/2002 | Leysieffer |
| 2003/0086582 | A1 | 5/2003 | Vonlanthen |
| 2007/0019817 | A1 | 1/2007 | Siltmann |
| 2007/0286441 | A1 | 12/2007 | Harsch et al. |

(Continued)

FOREIGN PATENT DOCUMENTS

| | | | |
|---|---|---|---|
| EP | 1 701 585 | A2 | 9/2006 |
| WO | WO 99/09799 | A2 | 3/1999 |

(Continued)

*Primary Examiner* — Harry S Hong
(74) *Attorney, Agent, or Firm* — Birch, Stewart, Kolasch & Birch, LLP

(57) ABSTRACT

The application relates to a test device for a speaker module of a listening device, the speaker module comprising a speaker unit for converting an electric output signal to an output sound. The application further relates to a test system and to a data update device. An object of the present application is to provide an alternative scheme for identifying a receiver (speaker) in a listening device, e.g. a hearing aid. The problem is solved in that the test device being a separate device adapted for being electrically connected to the speaker module in a test situation, but not during normal operation of the listening device. An advantage of the invention is that it provides a flexible alternative to a receiver identification solution that is integrated into the listening device.

22 Claims, 5 Drawing Sheets

(56) References Cited

U.S. PATENT DOCUMENTS

| | | | | |
|---|---|---|---|---|
| 2008/0008340 | A1 | 1/2008 | Bachler et al. | |
| 2009/0028364 | A1 | 1/2009 | Vonlanthen | |
| 2009/0052706 | A1 | 2/2009 | Gottschalk et al. | |
| 2009/0103754 | A1 | 4/2009 | Gottschalk et al. | |
| 2010/0272272 | A1* | 10/2010 | Muller et al. | 381/60 |

FOREIGN PATENT DOCUMENTS

| | | | |
|---|---|---|---|
| WO | WO 02/11509 | A1 | 2/2002 |
| WO | WO 2006/071210 | A1 | 7/2006 |
| WO | WO 2007/045254 | A1 | 4/2007 |
| WO | WO 2009/006889 | A1 | 1/2009 |
| WO | WO 2009/065742 | A1 | 5/2009 |

* cited by examiner

TEST DEVICE FOR A SPEAKER MODULE FOR A LISTENING DEVICE

CROSS REFERENCE TO RELATED APPLICATIONS

This nonprovisional application claims the benefit of U.S. Provisional Application No. 61/607,026 filed on Mar. 6, 2012 and to Patent Application No. 12158242.3 filed in the European Patent Office, on Mar. 6, 2012. The entire contents of all of the above applications are hereby incorporated by reference.

TECHNICAL FIELD

The present application relates to characterization of a module in a listening device, e.g. a hearing aid, the module comprising a loudspeaker. The module is termed 'speaker module' in the following (the term 'loudspeaker' is used interchangeably with the terms 'receiver' and 'speaker unit' in the present application). The disclosure relates specifically to a test device for a speaker module of a listening device, the speaker module comprising a speaker unit for converting an electric output signal to an output sound.

The application furthermore relates to a test system comprising a test device and a speaker module, to a fitting system and test device combination, and to a test device and listening device combination. The application also relates to a data update device for transferring data to a listening device, and to a combination of a test device and a data update device.

The disclosure may e.g. be useful in listening devices where the characterization of a loudspeaker is of importance for the functionality of the device, such as in hearing aids, headsets, ear phones, active ear protection systems, telephone handsets (cellular or fixed line), etc.

BACKGROUND

The following account of the prior art relates to one of the areas of application of the present application, hearing aids.

As the market for 'Receiver in the Ear' (RITE) hearing aids (HA's) increases, more RITE modules with different receivers (speakers) will come to co-exist in the coming years. A strategy for identifying and distinguishing these RITE modules is needed to ensure that future HA solutions will not impose damage and/or produce uncomfortable (or too weak) sound levels to the end user in case of attaching a wrong RITE module, e.g. one with higher (or lower) sensitivity than expected during fitting. A mechanical differentiation between different modules is possible, e.g. by having different connectors with different mechanical properties, e.g. from, is possible. Such solution is, however, not attractive due to cost of production and the complexity of handling of several different variants of 'the same' component/module.

In practice, each receiver has different physical properties (e.g. frequency response) depending firstly on receiver type (intended technical specifications) and secondly on product variations within a given type. Knowledge of the exact properties (e.g. response) of a given receiver can be used to obtain a more precise amplification (possibly without knowing its type). Knowledge of the properties (e.g. frequency response) of a particular receiver is useful not only in a hearing aid where the receiver is located in a separate body but also in a hearing aid, where the receiver is implemented in the hearing aid-body, e.g. together with a processing unit.

Further, WO 2009/065742 A1 addresses the problem of identification of individual receiver properties as well as of identifying different types of receivers. The term type (or model or version) is used to mean identification of a class of receivers comprising a larger number of individual items, which are intended to have the same properties. A type of receiver can e.g. be characterized by its intended technical specifications, such as its input sensitivity and/or max output volume. The term type of receiver is on the other hand not intended to provide a unique identification of the individual receiver (such as its individual detailed frequency response).

US 2002/0015506 A1 deals with a selector module or component tester provided to a user for selecting one of multiple acoustical formats of a hearing aid device. Preferably, the acoustical format defines an acoustical response of the hearing aid device for an entire continuous range of frequencies detectable by a human ear. The component tester is e.g. used to test a receiver or speaker of a hearing aid device. Generally, a compensation factor is assigned to a tested component depending upon a variation of the component from a standard. When a device such as a hearing aid is assembled including a particular tested component, the compensation factor corresponding to the component is programmed in the device so that a response of the device conforms to a desired standard or norm.

SUMMARY

An object of the present application is to provide an alternative scheme for identifying a receiver (speaker) in a listening device, e.g. a hearing aid. This functionality (and thus any device or system providing it) is mainly aimed at a specialist for adapting or configuring a listening device according to certain specifications, e.g. a user's needs or preferences. Such specialist may e.g. be an audiologist whose task may be to fit a hearing aid to a user's needs, including the task of adapting the listening device (hearing aid) to compensate for the user's hearing impairment. Alternatively or additionally, such functionality may be useful during production and/or test of listening devices, including during attempts to find errors in newly produced listening devices or in listening devices already taken into use, and reported to be erroneous and thus turned in for repair or full or partial replacement.

Objects of the application are achieved by the invention described in the accompanying claims and as described in the following.

A Test Device:

In an aspect of the present application, an object of the application is achieved by a test device for a speaker module of a listening device, the speaker module comprising a speaker unit for converting an electric output signal to an output sound, the test device being a separate device adapted for being electrically connected to the speaker module in a test situation, but not during normal operation of the listening device.

An advantage of the invention is that it provides a flexible alternative to a receiver identification solution that is integrated into the listening device.

The term 'a separate device' is in the present context taken to mean separate from other devices (e.g. in that it has its own housing), in particular from the listening device, i.e. not being physically (or electrically) connected to the listening device during normal operation of the listening device. The test device is thus only connected to the speaker module in a test situation. The test device is not connected to the speaker module (or other parts of the listening device) during normal operation of the listening device In an embodiment, the test device comprises a connector (termed the TD-SM connector) adapted for matching a connector of the speaker module (termed the SM connector) and allowing an electrical connection to be established between the two devices when said connectors are operationally connected. In an embodiment, the test device comprises several connectors (or an adaptor) allowing it to be electrically connected to a number of different speaker modules having different connectors matching one of the connectors of the test device. In an embodiment, the test device is adapted to allow a connector to be exchanged with a new one (of identical or different type).

In an embodiment, the test device comprises a connector (termed the TD-OM connector) adapted for matching a connector of the other module of the listening device (termed the OM connector) and allowing an electrical connection to be established between the two parts when said connectors are operationally connected.

In an embodiment, the test device comprises a charging unit adapted to charge a rechargeable battery located in the speaker module (e.g. via the TD-SM, SM connectors) and/or in another part of the listening device (e.g. via the TD-OM, OM connectors) when the speaker module and/or the other part, respectively, is/are mounted in the test device. A charging system is e.g. described in EP 2178315 A2.

In an embodiment, the test device comprises a data update facility for transferring data to the listening device as described below. Such data may comprise data selected from one or more of the following processing algorithms (e.g. algorithms relating to noise reduction, feedback estimation, compression, directionality, etc.), processing algorithm updates, user specific data or customized data (e.g. parameter settings, user identification data, hearing thresholds, etc.).

An advantage of implementing the characterization of the speaker module in a separate test device as proposed in the present application is that the implemented detection scheme can be made more advanced than when implemented in a listening device, e.g. a hearing aid (subject to space and power consumption constraints). For example, a more accurate measurement of components (e.g. resistor) values and speaker unit impedances can be implemented in the test device, because space and power consumption constraints are (much) less strict (practically non-existent) in a separate test device. This has e.g. the advantage that a larger number of different modules can be differentiated (component values representing different types of speaker modules can be closer).

In an embodiment, the test device has an interface to fitting software run on a programming device (e.g. a PC). This has the advantage that the introduction of new speaker modules (e.g. having new component (e.g. resistor) identification values) is easily arranged. In an embodiment, the test device comprises a connector (e.g. a USB connector) for establishing a wired connection to the programming device, whereby data can be exchanged between the test device and the programming device (running fitting software) and the test device can be energized from such other device. Alternatively or additionally, the test device comprises a wireless interface to the programming device.

In an embodiment, the test device comprises

- a communication interface to a programming device for modifying parameters of said listening device according to a user's needs, and/or
- a communication interface to a network for exchanging data with a server connected to the network.

In an embodiment, the data update facility for transferring data to the listening device is configured to transfer said data via one of said communication interfaces.

In an embodiment, the test device comprises a housing for enclosing and/or providing access to (e.g. connectors or speaker openings) the functional components of the test device.

In an embodiment, the test device comprises the TD-SM connector allowing an electrical connection to be established between the test device and the speaker module, and an interface to fitting software run on a programming device, said connector being electrically connected to said interface. Thereby a very simple test device is provided that merely facilitates electrical connection of the speaker module to fitting software of a programming device. Characterization of the speaker module is performed by the fitting software and appropriate measurement circuitry of the programming device.

In an embodiment, the test device comprises a measurement unit for performing a measurement contributing to a characterization of the speaker module.

The term 'characterizing' the or 'a characterization' of the speaker module is in the present context taken to mean a) providing a unique identification of an individual speaker module (such as its individual frequency response or impedance) and/or b) identifying its type (or model or version) defining intended technical specifications (e.g. its maximum power output). The characterization of a speaker module typically relates to electro-acoustic properties of the speaker module (including the particular speaker unit in question).

The characterization process comprises a measurement process, wherein a property of the speaker module is measured. In an embodiment, the characterization process further comprises an identification process, wherein results of the measurement process are used to identify a type of the speaker module by comparison with values of said measured property for a number of different types of speaker modules, such values being e.g. stored in a memory.

One purpose of the test device is to facilitate the verification of whether a specific speaker module for a listening device is a desired one. The characterization of the speaker module provides a basis for deciding whether it is of an intended type and/or has intended technical specifications. This characterization process is in the present application termed 'RITE detection'.

RITE detection can be based on a variety of measurements and may depend on one or more electronic components (be they passive or active) included in the speaker module (e.g. specifically for identification purposes). RITE detection may e.g. be based on measuring:

- a value of a built-in electronic component, (e.g. a resistor) in the speaker module;
- the impedance or frequency response of the speaker unit itself.

In an embodiment, the test device providing RITE detection is a stand-alone measuring box or a measuring box connected to fitting software (executed on a programming device, e.g. a PC). In an embodiment, the test device provides electrical connection between the speaker module and a fitting system for influencing the functionality of the listening device, which the speaker module forms part of. In an embodiment, characterization of the speaker module is fully or partially performed by the test device. In an embodiment, characterization of the speaker module is fully or partially performed by a fitting system connected to the test device. In an embodiment, characterization of the speaker module is performed in collaboration between the test device and a fitting system (e.g. while electrically connected to the test device).

According to the present application, RITE detection is not performed in the listening device (e.g. a hearing aid), but in a test device (or—via the test device—in a device connected to the test device, e.g. a fitting system).

Before attaching a speaker module to (another part of) the listening device, the speaker module (including the speaker unit) is connected to the test device. In an embodiment, the test device is adapted to measure or read one or more of the following (and possibly compare the results):

- a built-in component (e.g. a resistor) value of the speaker module;
- the impedance of the speaker unit itself;
- the contents of an RFID tag attached to or included in the speaker module;
- the contents of a memory holding data for characterizing the speaker unit.

In an embodiment, the test device is adapted to identify a type of speaker module from one or more (or all) of said measurements.

In an embodiment, the test device is adapted to measure a value of an electronic component built-into the speaker module as well as to measure the impedance of the speaker unit of the speaker module. In an embodiment, the test device (or a device connected to the test device, e.g. a fitting system) is adapted to compare the results of the two measurements and identify possible differences in the identified type. Thereby a cause for a possible problem may be identified and presented to a user (e.g. via a user interface of the test device or on a connected device or system).

In an embodiment, the test device comprises a reference electric component (e.g. a reference resistor) for use in characterizing an electric identification component located in the speaker module.

In an embodiment, the test device comprises circuitry adapted to measure a frequency response characteristic of the speaker unit (e.g. to measure corresponding values of voltage and current at different frequencies). In an embodiment, test device comprises a signal generator for applying a specific signal to the speaker unit. In an embodiment, test device comprises a frequency analysis unit for analyzing a signal response from the speaker unit when subject to a specific signal (e.g. from a signal generator).

In an embodiment, the test device comprises an indicator (e.g. one or more light indicators (e.g. LEDs) or a display) allowing the speaker type or other results of a measurement being performed by on the speaker module to be relayed to a person operating the test device. Alternatively or additionally, the test device is adapted to relay such results to a device (e.g. a computer) connected to the test device (e.g. (but not necessarily) a programming device running a fitting software for configuring the listening device) for optional further processing and/or presentation thereon. Alternatively, the results (e.g. speaker type) can be relayed by other indicators, e.g. acoustic, e.g. by a voiced message, e.g. located in the test device (or a device connected to it).

If the impedance of the speaker unit is measured, such value is preferably communicated to fitting software of a programming unit. The fitting software can be adapted to compensate for a spread in speaker unit impedance, e.g. by adapting signal processing parameters (e.g. gain or attenuation values) of a processing unit of the listening device.

In an embodiment, the test device is a portable device. In an embodiment, the test device comprises a local energy source, e.g. a battery, e.g. a rechargeable battery. In an embodiment, the test device is adapted to receive its energy supply from a separate source, e.g. a mains supply or another device, e.g. a PC, e.g. via a cable, e.g. comprising a USB connector.

In an embodiment, the test device comprises a user interface, e.g. an activation element, for initiating a characterization measurement.

A Test System:

In an aspect, a test system comprising a test device and a speaker module is furthermore provided by the present application. The test device is a test device as described above, in the 'detailed description of embodiments' and in the claims.

The speaker module comprises a speaker unit and a connector for electrically connecting the speaker unit to the test device. The connector allows a measurement on the speaker module to be carried out by or via the test device, when the two devices are electrically connected in an operational state. In an embodiment, the speaker module comprises a connector for electrically connecting the speaker unit to another part of a listening device during normal operation of the listening device and speaker module (where an electric signal comprising audio, originating from the other device and delivered to the speaker module via said connector is converted to an acoustic signal for being presented to a user wearing the listening device). Preferably, the speaker module is not operationally connected to other parts of the listening device, when electrically connected to the test device.

In an embodiment, the speaker module comprises further functional components of the listening device, e.g. a microphone for picking up a sound from the environment and/or from an enclosed volume of the ear canal (e.g. near the ear drum). In an embodiment, the speaker module comprises a processing unit.

In an embodiment, the speaker module comprises a battery for energizing the speaker module. In an embodiment, the speaker module comprises a battery for (additionally) energizing further parts of the listening device separate from the speaker module but electrically connected during normal operation of the listening device.

In an embodiment, the speaker module comprises an electronic identification element for indicating a characterization of the speaker module, in particular the speaker unit. In an embodiment, the electronic identification element comprises one or more of a resistor, a capacitor, an inductor, a memory, and an RFID tag. In an embodiment, the electronic identification component is located in connection with the speaker unit, e.g. electrically connected to the speaker unit, e.g. to a housing of the speaker unit.

In an embodiment, the speaker module comprises different selectable impedances that may be combined to provide different resulting impedances (and thus different maximum power output (MPO)), e.g. to implement different speaker module types. In an embodiment, such configurable speaker module type may be configured on the speaker module itself by a mechanical switch and/or via the test device using a control signal entered by a user (e.g. via a user interface on the test device or via a programming unit (e.g. fitting software) connected to the test device).

In an embodiment, the test device and the speaker module comprises respective matching connectors (e.g. respective plug and socket connectors) adapted for allowing an electrical connection to be established between the two devices when said connectors are operationally connected.

In an embodiment, the electronic identification component is located in connection with the connector of the speaker module, e.g. electrically connected to the connector, e.g. to an electric contact, e.g. a pin, of the connector.

In an embodiment, the (SM) connector of the speaker module used to electrically connect the speaker module to the test device additionally allows an electrical connection of the speaker module to another part (module) of the listening device to be established via a matching (OM) connector on the other module. In an embodiment, the other part is a BTE-part adapted for being worn at or behind an ear of the user, when the BTE-part and the speaker module are operationally connected via corresponding (SM, OM) connectors.

In an embodiment, the speaker module comprises an electrical (SM) connector for electrical connection to a matching (TD-SM) connector on the test device, a housing enclosing the speaker unit, and a connecting element (e.g. comprising a cable comprising electrical conductors) electrically connecting the electrical (SM) connector and the speaker unit (and possibly other parts of the speaker module). In an embodiment, the electronic identification component is located in or form part of the connecting element. In an embodiment, the electronic identification component is located in or form part of said housing.

In an embodiment, the test system comprises a data update facility for transferring data to a listening device (when the listening device is connected to the test system, e.g. the test device).

A Fitting System and Test Device Combination:

In a further aspect, a fitting system and test device combination is furthermore provided. The fitting system and test device combination comprises a fitting system for modifying processing parameters of a listening device and a test device as described above, in the 'detailed description of embodiments' and in the claims.

In an embodiment, the fitting system is a programming device for running fitting software to customize (e.g. software features of) a listening device according to a user's needs.

In an embodiment, the fitting system and test device is adapted to transfer measurement results from the test device to the fitting system for further processing by the fitting system, e.g. for display of (possibly further processed) results. In an embodiment, the fitting system and test device is adapted to process measurement results provided by a measurement unit of the test device to determine the type of receiver module being tested by the test device.

In an embodiment, the fitting system and test device is adapted to initiate the characterization measurement in the test device.

A Test Device and Listening Device Combination:

In a further aspect, a test device and listening device combination is furthermore provided. The test device and listening device combination comprises

- a test device as described above, in the 'detailed description of embodiments' and in the claims comprising a test device (TD-) electric connector, and
- a listening device, the listening device comprising
  - a speaker module comprising a speaker module (SM-) electric connector, and
  - another module having another module (OM-) electric connector, wherein said SM- and OM-electric connectors are adapted to allow electrical connection to be established between said speaker module and said other module of the listening device when said SM- and OM-electric connectors are operationally connected, and wherein said TD- and SM-electric connectors are adapted to allow electrical connection to be established between said test device and said speaker module when said TD- and SM-electric connectors are operationally connected.

The test device does not form part of the listening device (which the speaker module is intended to form part of/be electrically connected to) during normal operation of the listening device. The test device is intended to be used in advance of normal operation of the listening device.

The speaker module comprises a speaker unit for converting an electric output signal to an output sound (when operationally connected to other parts of the listening device).

In an embodiment, the other module of the listening device is adapted to provide an electric output signal comprising audio for being transferred to the speaker module when said SM- and OM-electric connectors are operationally connected. The speaker module is adapted to convert the transferred electric output signal comprising audio (or a signal originating therefrom) to an output sound via the speaker unit.

In an embodiment, the listening device is adapted to provide a frequency dependent gain to compensate for a hearing loss of a user. In an embodiment, the listening device comprises a signal processing unit for enhancing the input signals and providing a processed output signal. Various aspects of digital hearing aids are described in [Schaub; 2008].

In an embodiment, the listening device is portable device, e.g. a device comprising a local energy source, e.g. a battery, e.g. a rechargeable battery. In an embodiment, the listening device is a low power device. The term 'low power device' is in the present context taken to mean a device whose energy budget is restricted, e.g. because it is a portable device, e.g. comprising an energy source of limited size, e.g. with a maximum capacity of 1000 mAh, such as 500 mAh), which—without being exchanged or recharged—is of limited (operational) duration (the limited duration being e.g. of the order of hours or days).

In an embodiment, the listening device comprises a hearing aid, e.g. a hearing instrument, e.g. a hearing instrument adapted for being located at the ear or fully or partially in the ear canal of a user, e.g. a headset, an earphone, an ear protection device or a combination thereof.

In an embodiment, the 'other module' of the listening device is a BTE-part adapted for being worn at or behind and ear of the user, when the BTE-part and the speaker module are operationally connected via said corresponding connectors, and while the speaker module is mounted in the ear canal of the user.

In an embodiment, the test device comprises a connector (termed the TD-OM connector) adapted for matching a connector of the other module of the listening device (termed the OM-TD connector) and allowing an electrical connection to be established between the two parts (modules) when said connectors are operationally connected. In an embodiment, the TD-OM connector is operationally connected to an interface to fitting software of the listening device (e.g. the same interface that is used to transfer data for a characterization of the speaker module). In an embodiment, the test device comprises an evaluation unit for evaluating an electric output signal of the other part of the listening device (the electric output signal comprising audio for being transferred to the speaker module). In an embodiment, the evaluation unit is adapted to decide whether the electric output signal from the other module is erroneous or OK. In an embodiment, the listening device is adapted to provide a test signal resulting in said electric output signal of the other part of the listening device. In an embodiment, the listening device (e.g. the other part) comprises a test signal generator for providing the test signal. Alternatively or additionally, the listening device comprises a programming interface to a programming unit running fitting software for the listening device and allowing a test signal to be applied to the listening device via said fitting software.

In an embodiment, the test device and listening device combination comprises a data update facility for transferring data to a listening device (when the listening device is connected to the test device).

A Test and Fitting System Combination:

In a further aspect, a test and fitting system combination is furthermore provided. The test and fitting system combination comprises a fitting system for modifying processing parameters of a listening device and a test system as described above, in the 'detailed description of embodiments' and in the claims.

Use:

In an aspect, use of a test device as described above, in the 'detailed description of embodiments' and in the claims, is moreover provided. In an embodiment, use is provided to characterize a speaker unit in a listening device selected from the group comprising hearing aids, headsets, ear phones, active ear protection systems, telephone handsets and combinations thereof.

A Data Update Device for a Listening Device:

In a further aspect, the present disclosure relates to a data update device for transferring data to a listening device (e.g. a hearing instrument). The data update device comprises transceiver circuitry for establishing a, preferably bi-directional, communication link to the listening device. The communication link may alternatively be uni-directional from the programming device to the listening device. The communication link may be wireless or based on a wired connection. The data update device (and the listening device) is adapted to allow the programming device to transmit basic data of the listening device to the listening device. The listening device comprises a memory for storing said basic data. Basic data of the listening device can in the present context be grouped in three different categories:

A) Major functional data: Processing algorithms that define a particular type or model of the listening device (the type or model e.g. having a particular product name that defines a number of features specific to that type or model). Examples of such data are algorithms relating to noise reduction, feedback estimation, compression, directionality.

B) Minor functional data: Versions of processing algorithms having different features (e.g. updated versions of processing algorithms)

C) User data: Data that are user specific and/or customized to the user (such as identification data, hearing thresholds, gain settings, etc.).

In an embodiment, the data update device comprises a memory wherein basic data of the listening device are stored. In an embodiment, the programming device (in addition to the interface to the listening device) comprises an interface to a network, e.g. the Internet, allowing basic data of the listening device to be uploaded to the programming device from a server (e.g. from a manufacturer or other service provider). In an embodiment, the data update device comprises an interface to a local computer (e.g. a PC) from which the transfer of basic data from the data update device to the listening device is controlled. In an embodiment, the local computer forms part of the data update device. Preferably, the local computer comprises an interface to a network, e.g. the Internet (in which case the data update device may not need an independent network interface). In an embodiment, basic data to be transferred from the data update device to the listening device are uploaded to the data update device from a server via the local computer (i.e. first uploaded to the local computer from the server and then transferred to the data update device from the local computer and then to the listening device from the data update device). In an embodiment, the data update device is adapted to record details of an upload of basic data from the server to the data update device (e.g. via the local computer). Thereby an economic account can be established allowing a service provider to charge the user for the services provided. Alternatively, the data update device can be enabled to allow different levels of upload of basic data, e.g. only level C), only level B) or only C), or level A), B) and C). In an embodiment, the data update device is adapted to provide that such enablement can be performed by a service provider via a network connection to the data update device (and/or via the local computer). In an embodiment, the data update device is adapted to transfer basic data from to the listening device, when the listening device is connected to the data update device. In an embodiment, the data update device is adapted to initiate transfer of data automatically, when the listening device is connected to the data update device. In an embodiment, the data update device is adapted to allow that transfer of data is initiated by activation via a user interface, e.g. an activation element on the listening device and/or on the data update device and/or on a device connected to the system (e.g. a PC or a remote control of the listening device).

In an embodiment, the data update device is a portable device. In an embodiment, the data update device comprises a local energy source, e.g. a battery, e.g. a rechargeable battery. In an embodiment, the data update device is adapted to receive its energy supply from a separate source, e.g. a mains supply or another device, e.g. a PC, e.g. via a cable, e.g. comprising a USB connector.

A Data Update System:

In an aspect, a data update system comprising a data update device and a listening device is furthermore provided. In an embodiment, the listening device and the data update device each comprise transceiver units allowing a communication link to be established between them. In an embodiment, the system is adapted to establish a wired connection between the data update device and the listening device, e.g. in that a connecting cable operationally connects the two devices and/or in that the two devices comprise respective matching connectors (e.g. of the plug and socket type). In an embodiment, such wired connection (incl. connectors) is adapted to be used for other purposes as well as for the transfer of data update data, e.g. for charging a rechargeable battery of the listening device and/or for characterizing or identifying a peripheral unit (e.g. a speaker module) of the listening device, etc.

Further objects of the application are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element or intervening elements may be present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The disclosure will be explained more fully below in connection with a preferred embodiment and with reference to the drawings in which.

The figures are schematic and simplified for clarity, and they just show details which are essential to the understanding of the disclosure, while other details are left out. Throughout, the same reference numerals are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

Figure 1A:
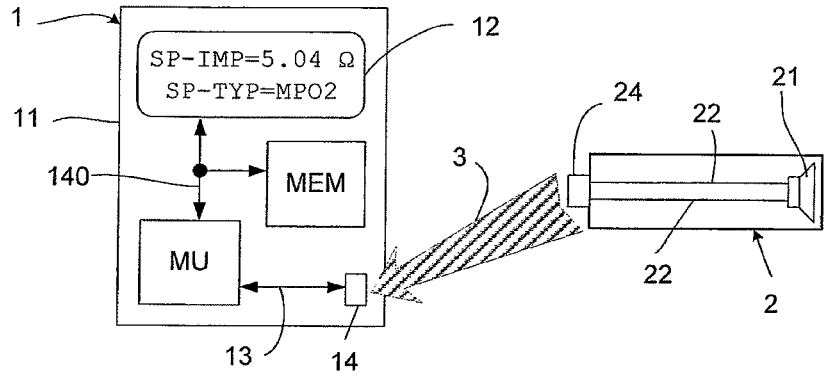
FIG. 1A-1D show embodiments of devices according to the present disclosure, FIG. 1A, 1B illustrating two embodiments of a test system comprising a test device and a speaker module, and FIG. 1C, 1D illustrating two embodiments of a test and fitting system combination comprising a fitting system, a test device and a speaker module.
Figure 1B:
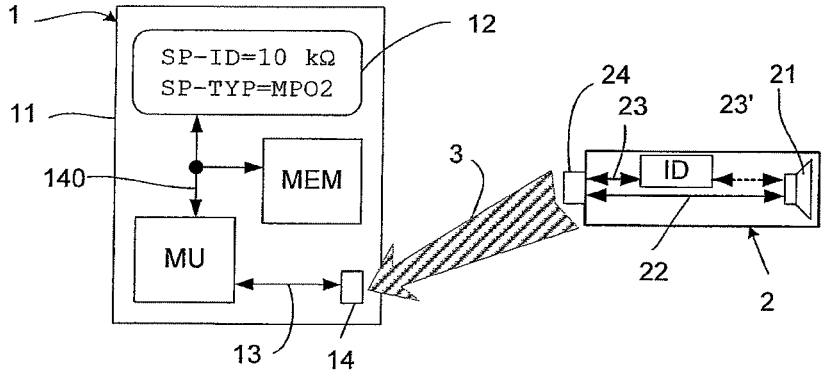
Figure 1C:
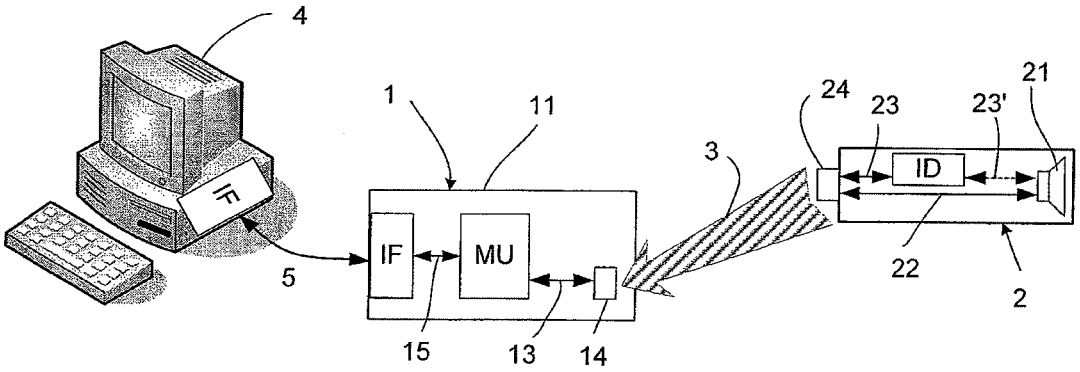
Figure 1D:
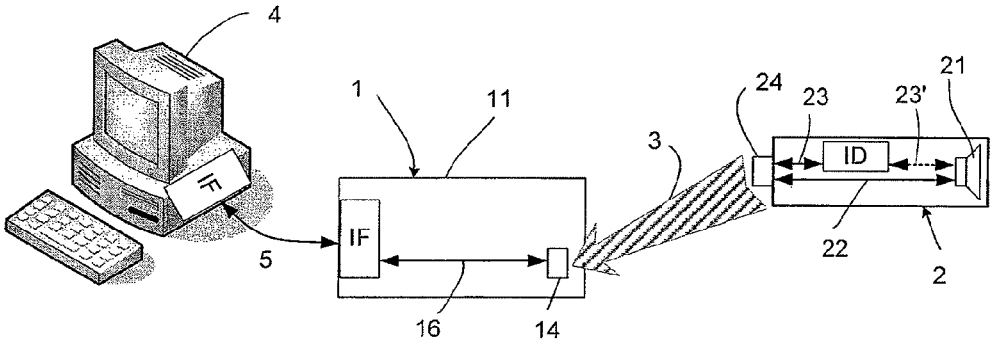

FIG. 1A-1D show embodiments of devices according to the present disclosure, FIG. 1A, 1B illustrating two embodiments of a test system comprising a test device 1 and a speaker module 2, and FIG. 1C, 1D illustrating two embodiments of a test and fitting system combination comprising a fitting system 4, a test device 1 and a speaker module 2.

FIG. 1A shows an embodiment of a test system comprising a test device 1 and a speaker module 2 for a listening device, e.g. a hearing aid. The speaker module 2 may e.g. be a RITE module of a hearing aid. The test device 1 comprises a connector 14, a measurement unit MU, a memory unit MEM, and a display 12 enclosed in a housing 11. The connector 14 for establishing electrical connection to the speaker module 2 is electrically connected by conductor(s) 13 to the measurement unit MU allowing a measurement to be performed on the speaker module 2. The measurement unit is e.g. adapted to measure the impedance of the speaker unit 21, e.g. estimated by corresponding values of an applied current and a resulting voltage (or vice versa) at a number of frequencies over the frequency range of operation of the speaker unit (e.g. between 20 Hz and 12 kHz). The memory unit MEM preferably contains corresponding values of impedance (e.g. impedance ranges, e.g. reflecting a tolerance range on the impedance of the speaker unit type in question) and speaker unit type, e.g. reflecting different maximum power output values (e.g. 80 dB SPL, 90 dB SPL, 100 dB SPL, etc., e.g. indicated by Type=MPO1, MPO2, MPO3, etc.). The measurement unit MU is electrically connected to memory unit MEM and display 12 by conductor(s) 140, thereby allowing the identification of speaker unit type based on the measurement performed by the measurement unit by comparison with the data stored in the memory unit MEM and the presentation of such results on the display 12.

The speaker module 2 comprises connector 24, speaker unit 21 and electrical conductors 22 connecting connector 24 and speaker unit 21, and allowing a measurement of the impedance of the speaker unit to be performed (when electrical connector 24 of the speaker module 2 is operationally joined with electrical connector 14 of the test device 1, as indicated by hatched arrow 3). Preferably, the same electrical conductors 22 can be used to propagate an electric output signal comprising audio to be converted to an output sound by speaker unit 21 from another part of a listening device when the other part is operationally connected to the speaker module via said electrical connector 24. More than two conductors and/or additional components may be included in the speaker module to aid in the characterization of the speaker module (and/or in the propagation of the audio signal).

FIG. 1B shows another embodiment of test system comprising a test device 1 and a speaker module 2 for a listening device. The same basic elements as described in connection with FIG. 1A are included in the embodiment of FIG. 1B. The speaker module 2 of FIG. 1B alternatively (or additionally) comprises an electronic identification element ID (e.g. a resistor) for identifying a type of speaker unit (and/or speaker module). The speaker module 2 comprises electric conductors 22, 23, 23' allowing a measurement on the electronic identification element ID to be performed (e.g. an estimation of a component value, e.g. voltage drop over a resistor, or the reading of a data value from a memory) via the measurement unit MU of the test device 1 (cf. e.g. FIG. 3). The measurement unit is adapted to perform a measurement on the electronic identification element ID of the speaker module 2, which contribute to the identification of speaker module. The memory unit MEM preferably contains corresponding values of component values of the electronic identification element ID (e.g. resistor values, e.g. $R_{ID}$=10 kΩ, 20 kΩ, 30 kΩ, etc.) and speaker unit type (e.g. indicated by Type=MPO1, MPO2, MPO3, etc.).

FIG. 1C shows a first embodiment of a test and fitting system combination comprising a fitting system 4, a test device 1 and a speaker module 2. The fitting system comprises a programming unit, here a personal computer (PC), running fitting software primarily for configuring a listening device to a user's needs. Thus the fitting system comprises a (wired or wireless) programming interface to the listening device for transferring data to and from the listening device, including configuration settings (e.g. the kind of peripherals, including speaker module) forming part of or attached to the listening device) and processing settings (cf. interface P-IF and link 8 in FIG. 4). Compared to the test system shown in FIG. 1B, a part of the processing (identification of the speaker module by comparison with stored data) and the display of results is carried out by or via the fitting system of the test and fitting system combination in FIG. 1C. In this system, the test device 1 is simpler and possibly limited to a measurement unit MU for performing a measurement on the electronic identification element ID of the speaker module 2 and electrically connected (via conductor 15) to an interface IF (established via wired or wireless connection 5) to the fitting system 4 and (via conductor 13) to a connector 14 for establishing electrical connection to the speaker module 2. The measurement unit MU may alternatively or additionally be adapted to measure an impedance or other property of the speaker unit 21. In an embodiment, the measurement unit MU (or a fitting system operationally connected to the measurement unit) is adapted to identify a type of speaker module from both measurements and to compare the results. This enables an identification of possible errors in the speaker module (in case the type of speaker module identified by the two measurements differs).

FIG. 1D shows a second embodiment of a test and fitting system combination comprising a fitting system 4, a test device 1 and a speaker module 2. The embodiment of FIG. 1D is identical to the embodiment of FIG. 1C apart from the fact the measurement on the electronic identification element ID (and/or on the speaker unit itself) is performed by the fitting system, so that the test device 1 is even simpler in the embodiment of FIG. 1D in that it only comprises a connector 14 for establishing electrical connection to the speaker module 2 and an interface IF to the fitting system 4, connector 14 and interface IF being connected by conductor 16. In an embodiment, the test device 1 is integrated with the fitting system 4 (e.g. enclosed or supported by the same housing).

Figure 2A:
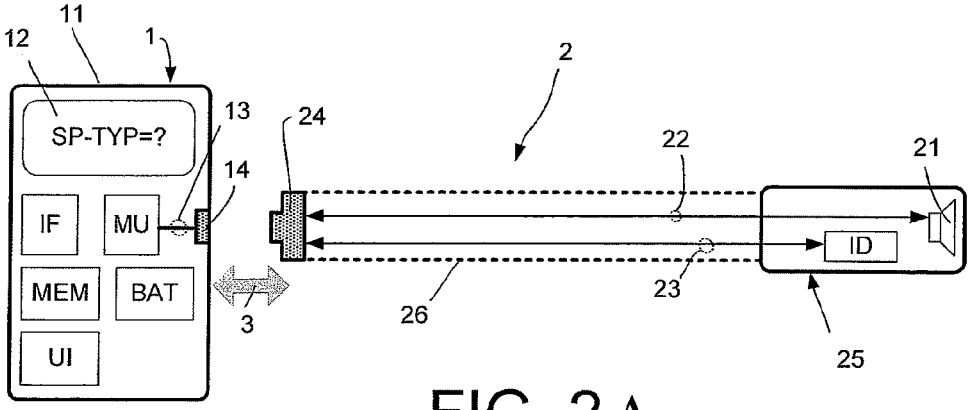
FIG. 2A-2B show an embodiment of a test system comprising a test device and a speaker module (FIG. 2A) and a listening device comprising said speaker module (FIG. 2B)
Figure 2B:
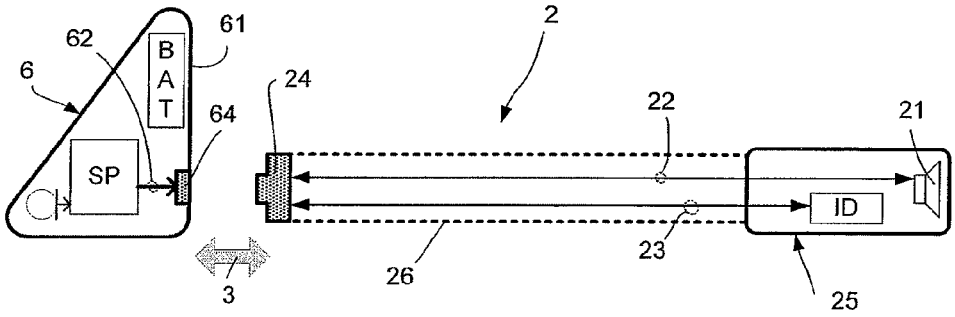

FIGS. 2A-2B show an embodiment of a test system comprising a test device 1 and a speaker module 2 (FIG. 2A) and a listening device (2, 6) comprising said speaker module 2 (FIG. 2B). FIGS. 2A-2B are intended to illustrate that the connector 24 of the speaker module 2 used to establish electrical connection to the test device 1 is also adapted for matching a connector 64 of the part 6 of the listening device providing the (electric) audio signal that is to be presented for the user via the speaker module 2.

The embodiment of a test system shown in FIG. 2A includes an embodiment of a test device 1 as shown in FIG. 1A, 1B but further comprising a local energy source, e.g. in the form of a battery (BAT, e.g. a rechargeable battery) to allow the test device 1 to be portable. The test device 1 further comprises an interface to another device or system (e.g. a fitting system as described in FIGS. 1C and 1D) and a user interface UI (e.g. an activation element, such as a number of buttons, e.g. a keyboard, e.g. allowing a user to initiate a measurement. The user interface UI may e.g. be combined with the display 12, e.g. as an interactive display (e.g. comprising a touch sensitive screen), or the like. The components or units—enclosed by a housing 11—are operationally connected by electric conductors, while only the connection 13 between measurement unit MU and electrical connector 14 allowing a measurement on the speaker module 2 to be carried out is shown.

The speaker module 2 comprises a housing 25 enclosing the speaker unit 21 and an electronic identification element ID. The connector 24 for connecting the speaker module to the test device 1 (and—during normal operation of the listening device—to another part 6 of the listening device) is electrically connected to the speaker unit 21 and to other components (e.g. the electronic identification element ID) via connections 22 and 23, respectively, e.g. arranged in a cable 26. Connections 22 and 23 may each comprise one or more electrical conductors and may or may not share one or more electrical conductors.

FIG. 2B illustrates a listening device comprising a speaker module 2 and another part of the listening device 6, e.g. a BTE-part. The connection of the speaker module 2 to the other part of the listening device 6 (under normal operation the listening device) by joining matching connectors 24 and 64, respectively, is indicated by arrow 3 in FIG. 2B. The speaker module 2 of FIG. 2B is identical to the speaker module 2 as described in FIG. 2A. The BTE part 6 of the listening device comprises a microphone for picking up a sound from the environment (and or another input transducer, e.g. a wireless receiver) a signal processing unit SP and a (possibly rechargeable) battery BAT. The components—enclosed by a housing 61—are intended to be operationally connected by electric conductors, even though only connection 62 between signal processing unit SP and electrical connector 64, the connection 62 providing an electric audio signal aimed at presentation to a user via speaker module 2 is shown. The housing 61 is adapted for being located behind an ear of a user and the speaker module 2 is adapted to be located in an ear canal of the user during normal operation of the listening device, where speaker module 2 and the BTE-part 6 are adapted to allow electrical connection between the two parts. The listening device comprising speaker module 2 and another part 6 may e.g. comprise a hearing aid, a headset, an ear phone, an active ear protection system, a telephone handset or a combination thereof.

Figure 3:
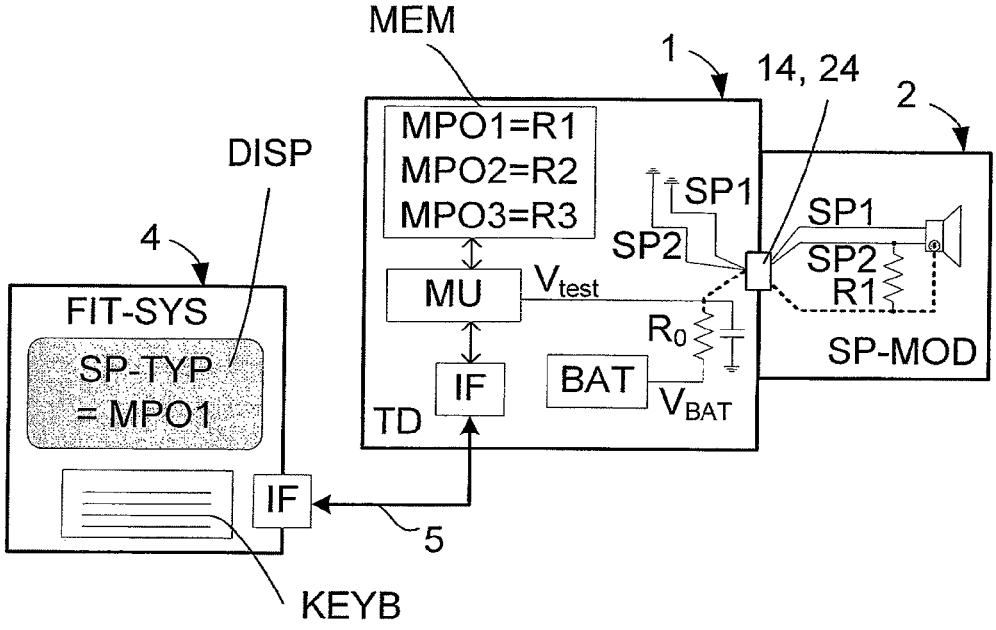
FIG. 3 shows an embodiment of a test and fitting system combination comprising a fitting system, a test device and a speaker module.

FIG. 3 shows an embodiment of a test and fitting system combination comprising a fitting system 4 for modifying processing parameters of a listening device, a test device 1 and a speaker module 2. The test device 1 and speaker module 2 (together termed 'test system') are illustrated to be in an electrically connected state (illustrated by their respective overlapping (matching) electrical connectors 14 and 24).

The fitting system 4 (also denoted FIT-SYS in FIG. 3) is in the present embodiment used to present results of the characterization of the speaker module 2 via a user interface. The user interface of the fitting system 4 comprises a display DISP for indicating a measurement result (here shown as SP-TYP=MPO1, indicating that the speaker module under test is of the type MPO1 corresponding to specific technical specifications of the speaker unit, including its maximum power output (MPO)). The user interface of the fitting system 4 further comprises a keyboard KEYB allowing a person e.g. an audiologist or other technically skilled person, to input commands or data into the fitting system, e.g. to control the measurement on the speaker module. Via a programming interface (cf. P-IF in FIG. 4) to the listening device, the fitting system is adapted to be able to modify software settings of a listening device in general and in particular concerning the type of speaker module to be included in the listening device. The fitting system 4 and the test device 1 each comprise an interface IF allowing the exchange of data and/or control signals between them via a wired or wireless connection 5. The test device 1 (also denoted TD in FIG. 3) comprises (as discussed in connection with FIG. 1A, 1B) a measurement unit MU a memory MEM and a connector 14 for electric connection to the speaker module 2. Corresponding values of speaker module type (denoted MPO1, MPO2, MPO3) and electronic identification element (here resistor) values (denoted R1, R2, R3, respectively) are stored in the memory MEM allowing the measurement unit MU (or alternatively, the fitting system) to determine the type of speaker module by comparison with the measured value of the identification resistor of the speaker module 2 (here 'R1'). The test device 1 comprises a reference electronic identification component (here resistor R0) having a first terminal connected to a reference voltage (here the battery voltage $V_{BAT}$ from a voltage supply (here a battery BAT) of the test device. Alternatively, the reference component may be connected to a reference voltage generated by an external device, e.g. the fitting system or a current source. The speaker module comprises identification resistor R1 having a first of its terminals connected to the second terminal of the reference resistor R0 of the test device 1. The second terminal of the identification resistor R1 is connected to a reference voltage in the test device (here ground) via an electric conductor (here SP2) in the speaker module and connectors 14, 24 (the other conductor SP1 is also connected to ground in the test device during measurement). A (decoupling capacitor to ground is connected in parallel to the reference resistor R0. In the embodiment of FIG. 3, the second terminal of identification resistor R1 is further connected to the speaker unit casing. In the embodiment of a speaker module 2 (also denoted SP-MOD in FIG. 3), three electrical conductors connect the test device and the speaker module, two conductors (SP1, SP2, indicated in solid line) are used for driving the speaker unit during normal operation of the listening device, and one conductor (indicated in dashed line) is used by the test device 1 (together with conductor SP2) to perform the voltage division measurement on identification resistor R1. The voltage drop (here $V_{test}$) over the identification resistor R1 of the speaker module 2 is measured by measurement unit MU and used to determine the ohmic resistance of R1 ($V_{test}=V_{BAT}\cdot(R1/(R0+R1)=>R1=R0\cdot(V_{test}/(V_{BAT}-V_{test}))$. Other ways of determining the resistor value R1 than the present DC voltage division measurement may of course be implemented in the test system (1, 2), e.g. a measurement allowing the use of the (AC) audio signal applied to the speaker unit via conductors SP1, SP2 (cf. e.g. EP 2280560 A1).

Figure 4:
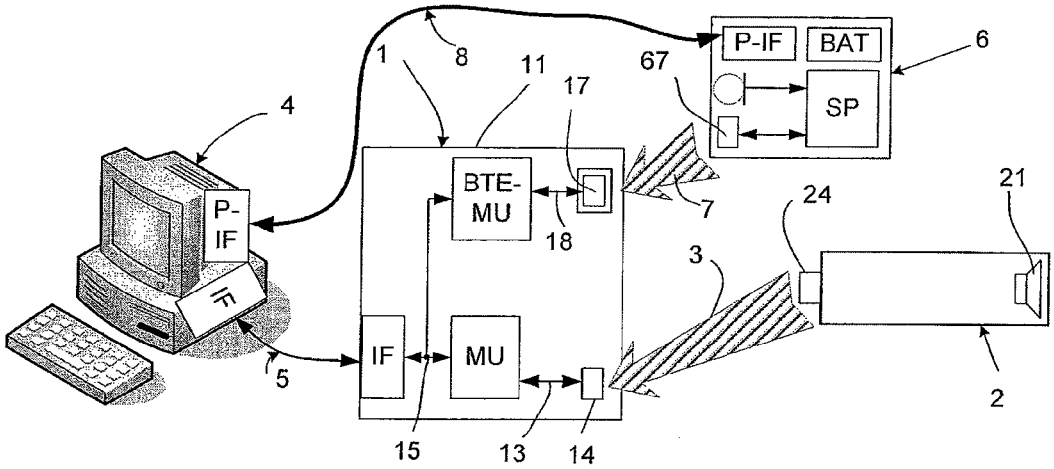
FIG. 4 shows an embodiment of a test and fitting system combination comprising a fitting system, a test device and a speaker module, further comprising another part of a listening (than the speaker module)

FIG. 4 shows an embodiment of a test and fitting system combination comprising a fitting system 4, a test device 1 and a speaker module 2, further comprising another part 6 of a listening (than the speaker module). The aim of the test and fitting system combination of FIG. 4 is to facilitate a simultaneous (parallel) verification of a speaker module and a part of a listening device intended to drive the speaker module (e.g. to provide the audio signal to be presented to the user as an output sound via the speaker unit). To that end, the test device further comprises a connector 17 allowing such 'other part' (module) 6, e.g. a BTE part, to be electrically connected to the test device 1. In an embodiment, electrical connector 17 comprises an electrical connector (at least mechanically) equal to electrical connector 24 of the speaker module 2. The test device 1 is further adapted to perform (or to enable) a measurement (via measurement unit BTE-MU electrically connected (via conductor 18) to connector 17) on the output signal of the other part 6 of the listening device. Thereby it may be concluded whether the electric output signal (comprising audio) provided by the other part 6 is as expected for the identified type of speaker module (or erroneous). An output signal may e.g. be generated by an acoustic (or direct electric audio) input to the other part 6 and/or by a test signal generated in the other part 6 of the listening device. The measurement unit BTE-MU is e.g. connected to the fitting system 4 via interface IF, the measurement unit BTE-MU, the interface IF and the measurement unit MU being connected by conductor 15. In case—as shown in FIG. 4—that the other part 6 of the listening device comprises a programming interface (P-IF) to the fitting system allowing software and parameters to be uploaded from the fitting system 4 to the listening device part 6 (via a wired or wireless connection 8), a characterization of the type of speaker module (e.g. to 'MPO1' as exemplified in FIG. 3) can be directly followed by an adaptation (via the programming interface P-IF) of settings in the other part 6 of the listening device to reflect the type of speaker used. Via the fitting software and the programming interface P-IF, a test signal can be applied to the other part 6 of the listening device, and the resulting output signal can be measured by the test device. Thereby the function and proper cooperation of the listening device components can be checked. Such setup may e.g. be used to identify malfunction in the listening device (e.g. in connection with production or when devices already in use are turned in for service), e.g. to decide which part of the device are working and which are not, e.g. to verify whether the speaker module is fully functioning or erroneous and/or to verify whether the other part 6, e.g. a BTE-part, is fully functioning or erroneous. In an embodiment, the system is adapted to present a message to the user, e.g. via a display on the test device and/or via a display of the fitting system 4.

The other part 6 of the listening device may e.g. be a BTE-part as described in connection with FIG. 2B. The connector 67 of the embodiment shown in FIG. 4 may e.g. be identical to the connector 64 of the embodiment shown in FIG. 2B (or at least being able to receive and connect to connector 24 of the speaker module 2). In addition to the functional components described in connection with FIG. 2B, the other part 6 comprises a (wireless or wired) programming interface (P-IF) to the fitting system 4 allowing the fitting system to adapt software and settings of the device, e.g. to a user's particular needs (e.g. hearing impairment) or to a particular configuration of the listening device (e.g. the type of speaker module 2 intended for connection to the other device 6).

The speaker module 2 may comprise an electronic identification element and/or other circuitry for aiding a characterization of the speaker module (including speaker unit 21), cf. e.g. FIG. 3. The test device may be adapted for identification of or reading an ID-code from of an electronic identification element of the speaker module (cf. e.g. FIG. 3) or to extract other characteristics of the speaker unit (e.g. its. frequency response or impedance, cf. e.g. FIG. 1A).

Figure 5A:
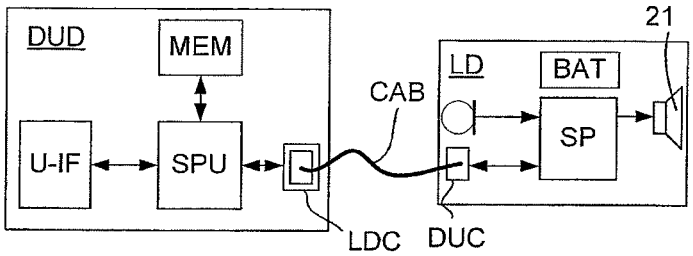
FIG. 5A-5C shows three embodiments of a data update system.
Figure 5B:
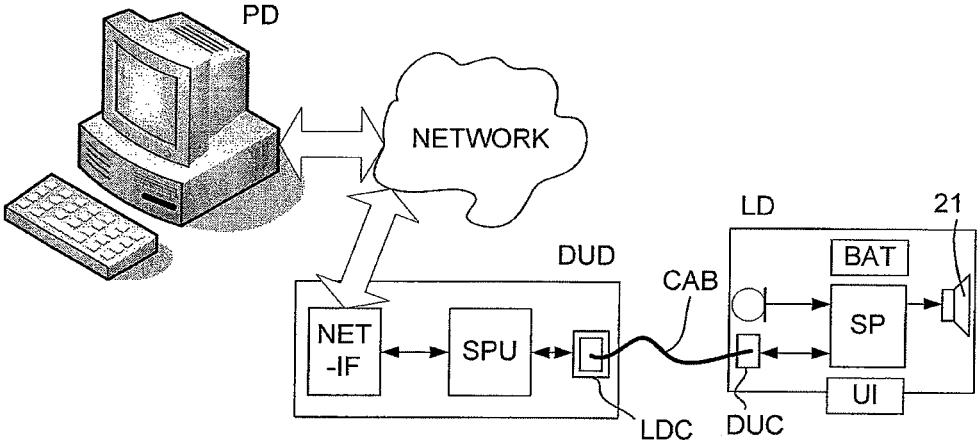
Figure 5C:
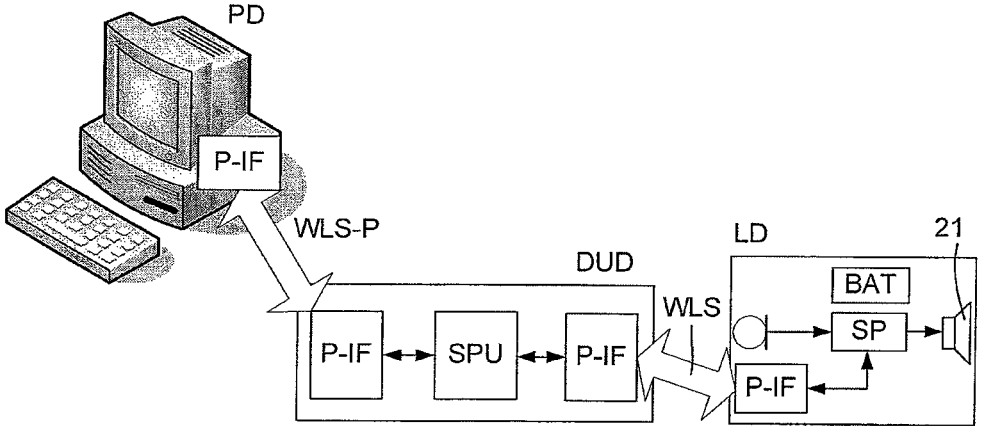

FIGS. 5A, 5B and 5C show three embodiments of a data update system. The data update system comprises a data update device DUD and a listening device LD. The system is intended for being used by a technical person (e.g. an audiologist) and located at an outlet of listening devices (e.g. hearing aids), e.g. for configuring a standard listening device with (software implemented) features to provide the features of a particular model of the listening device and/or to upgrade a listening device with particular (e.g. new) features according to a user's wishes. Alternatively, the data update system can be configured for being located with and used by an end-user, e.g. for allowing the end-user to upgrade his or her listening device with new (or existing) features that can be uploaded to the listening device from the data upgrade device, e.g. via a network connection from the data upgrade device to a server availing such upgrades (e.g. including some sort of invoicing for the services used).

The listening device LD comprises a forward path comprising a microphone unit, a signal processing unit SP, and a speaker unit 21. The microphone unit is arranged to pick up an input sound from the environment of the listening device and convert it to an electrical signal, the microphone being connected to the signal processing unit. The signal processing unit SP is adapted to process an input signal (originating) from the microphone and to provide a processed (enhanced) output signal. The speaker 21 is connected to the signal processing unit and arranged to convert a signal of the forward path (representing a processed version of the input signal picked up by the microphone) to an output sound for presentation to a user of the listening device. The listening device LD further comprises a local source of energy, e.g. a battery BAT. The listening device LD further comprises an interface to the data update device DUD, e.g. a wireless interface, e.g. comprising transceiver circuitry P-IF for establishing wireless link WLS, as indicated in FIG. 5C, or as shown in FIG. 5A, 5B, a wired interface, e.g. comprising a cable CAB with connectors, DUC (of the listening device) and LDC (of the data update device), respectively, for connecting to the listening device and/or to the data update device. The (wireless or wired) interface is adapted to at least allow the transfer of data from the data update device to the listening device (but preferably, however, to provide a two-way link allowing an exchange of data between the two devices). The embodiment of a listening device LD shown in FIG. 5B comprises a user interface UI, e.g. an activation element, allowing a user to modify operating parameters of the listening device (e.g. program changes, volume settings, etc.) and/or to initiate communication with the data update device DUD. Alternatively or additionally, such user interface UI may be embodied in a remote control device, allowing a more complex user interface to be established.

FIG. 5A shows a simple embodiment of the system, where the listening device and the data update device are adapted to establish a wired connection between them in that a connecting cable CAB operationally connects the two devices in that the two devices comprise respective matching connectors LDC, DUC (e.g. of the plug and socket type). In an embodiment, the wired connection uses a programming interface of the listening device. In an embodiment, connectors are only used at one end (e.g. in the listening device) of the cable (while fixed galvanic contacts are used at the other end (e.g. in the data up date device). In an embodiment, such wired connection (incl. connectors) is adapted to be used for other purposes as well as for the transfer of update data, e.g. for charging a rechargeable battery of the listening device and/or for characterizing or identifying a peripheral unit (e.g. a speaker module) of the listening device, etc. The data update device DUD comprises memory unit MEM for storing data of the listening device (e.g. processing algorithms, e.g. algorithms relating to noise reduction, feedback estimation, compression, directionality, etc., processing algorithm updates, user specific and/or customized data, e.g. parameter settings, user identification data, hearing thresholds, etc.). The data update device DUD further comprises a processor SPU for handling the communication with the memory unit, the listening device and a user interface U-IF. A data update transfer may e.g. be initiated via the user interface. The user interface U-IF may e.g. comprise a keyboard and a display (e.g. integrated in a touch sensitive display). The data update device DUD may be adapted for being used by an end-user (a wearer of the listening device). Preferably, the data update device DUD further comprises an interface to a network, allowing the contents of the memory unit MEM to be updated (and an economic transaction to be related to a data update transfer, if relevant) via a connection to a server. Alternatively or additionally, the data update device DUD comprises an interface to an external memory medium, e.g. a memory stick or an external hard disk, e.g. connected to the data update device DUD via a standard connector, e.g. a USB connector.

FIG. 5B shows an embodiment of a data update system comprising a listening device LD as described in connection with FIG. 5A and a data update device DUD, which instead of being 'stand alone' (as in FIG. 5A) is connected (or connectable) to a programming device or server PD, via a network interface NET-IF and a network NETWORK, e.g. the Internet. In this embodiment of a data update device DUD, the data for use in an update of data in the listening device are located on the programming device/server PD (i.e. not necessarily stored in the data update device). In an embodiment, an update of the listening device LD is performed (or managed) by a person operating the (remotely located) programming device PD via the network. In an embodiment, the data update device DUD further comprises a user interface allowing the user to initiate a (by establishing a connection to the programming device/server PD). In an embodiment, an update of the listening device LD can be initiated by via the user interface of the data update device DUD or alternatively via the user interface UI (e.g. a remote control) on the listening device LD, without additional operation from a person at the server-end.

FIG. 5C shows an embodiment of a data update system comprising a listening device LD as described in connection with FIG. 5A, but having a wireless interface (P-IF, WLS) to the data update device DUD, instead of a wired interface. The data update device DUD is similar to the one described in FIG. 5B, only that the interface to a programming device/server PD is not via a network as in FIG. 5B but a point-to-point wireless link WLS-P established via transceiver circuitry P-IF in the programming device/server and the data update device. The programming device/server PD is adapted to run a (possibly limited version of) programming software for the listening device (e.g. comprising selected options of a fitting software of a hearing aid) allowing the listening device to be configured and adapted to a user's needs via the data update device DUD. This embodiment of the data update system may be used by an end-user, e.g. having relevant software for communication with the data update device installed on his or her PC. Alternatively it may be used by a technical person (e.g. an audiologist), where the programming device/server PD is adapted to run programming software for the listening device (e.g. a fitting software of a hearing aid) and comprises the newest versions of basic software (incl. firmware) and software updates for the listening device.

The embodiments of a listening device LD illustrated in FIGS. 5A, 5B and 5C are shown as one unit. In practice the functional blocks of the listening device may be partitioned in a number of separate, connectable bodies, e.g. two or more. In an embodiment, the listening device comprises a separate speaker module 2 as described in connection with FIG. 1-4.

Figure 6:
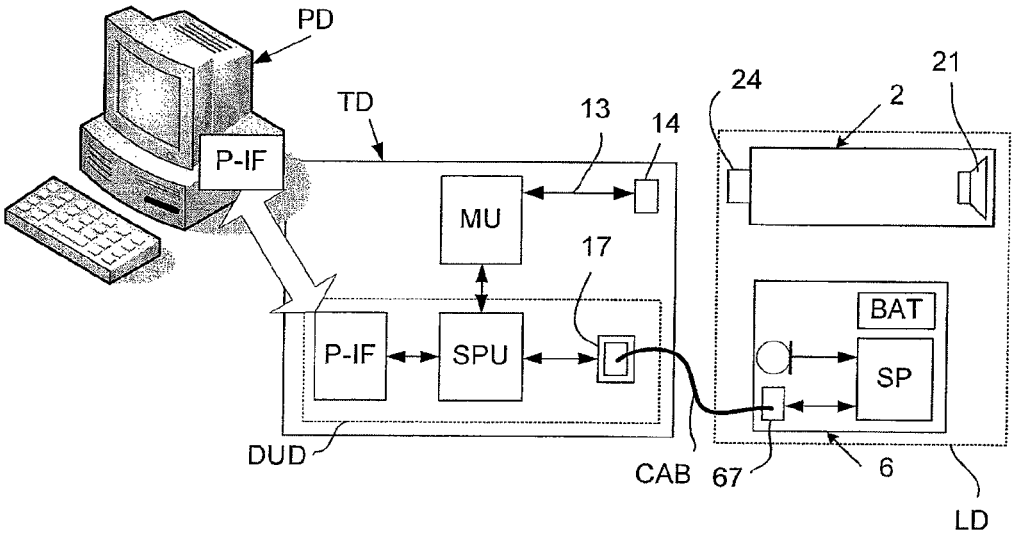
FIG. 6 shows an embodiment of a test and fitting system combination comprising a fitting system, a test device (incorporating a data update device) and a listening device comprising a speaker module and another part adapted for being connected to the speaker module during normal operation of the listening device.

FIG. 6 shows an embodiment of a test and fitting system combination comprising a fitting system PD, a test device TD (incorporating a data update device DUD) and a listening device LD comprising a speaker module 2 and another part 6 adapted for being connected to the speaker module during normal operation of the listening device. The speaker module 2 comprises a speaker unit 21 and a connector 24 for establishing electrical connection to a corresponding connector 14 on the test device TD (and to the other part 6 during normal operation of the listening device, e.g. via connector 67). The speaker module can be embodied in several ways as e.g. described in connection with FIG. 1-4). The other part 6 of the listening device comprises a microphone a signal processing unit SP, a battery BAT and connector 67 operationally connected via appropriate conductors. The speaker module 2 and the other part 6 are separate devices adapted for being electrically connected during normal operation of the listening device. The other part 6 of the listening device may e.g. be embodied as described in connection with FIGS. 2A, 2B and 4. Together the two parts may constitute the listening device, e.g. a hearing aid or a headset. The test device TD comprises a measurement unit MU and connector 14 allowing the performance of a measurement on the speaker module 2 when speaker module and test device are electrically connected via connectors 14 and 24 as described in connection with FIG. 1-4. The test device TD further comprises a data update unit DUD for transferring data to (and possibly from) the listening device via a wired connection (cable CAB and connectors 17, 67) as described in connection with FIG. 5A-5C. The processor SPU of the test device TD (shown to form part of the data update device part) is also adapted to control the measurement on the speaker module 2 (via programming device PD). The programming device PD is adapted to run programming software for the listening device (e.g. a fitting software of a hearing aid) and comprises the newest versions of basic software (incl. firmware) and software updates for the listening device as described in connection with FIGS. 1C, 1D, 3, 4, and 5A-5C. The test and fitting system combination shown in FIG. 6 may e.g. be used in a production setup for configuring newly manufactured listening devices or in a sales setup where a configuration of the listening device to a particular customer's needs is involved or in case of identifying erroneous devices (in particular erroneous or wrong parts of such devices), to aid in a faster clarification of problem and cause in a given case. Preferably, the system is adapted to display meaningful messages (e.g. via a display of the fitting system PD) assisting an operator (e.g. an audiologist) in such clarification.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims.

REFERENCES

[Schaub; 2008] Arthur Schaub, Digital hearing Aids, Thieme Medical. Pub., 2008.

WO 2009/065742 A1 (OTICON, BERNAFON) May 28, 2009

EP 2178315 A2 (OTICON) Apr. 21, 2010

EP 2280560 A1 (BERNAFON) Feb. 2, 2011

The invention claimed is:

1. A test device for testing a speaker module of a listening device, the speaker module comprising a speaker unit for converting an electric output signal to an output sound, an identification resistor, and an electrical connector configured to detachably connect to the listening device, the test device comprising:

a housing separate from the speaker module and separate from the listening device;

a first communication interface configured to electrically connect to the electrical connector of the speaker module;

a second communication interface configured to connect to a programming device for modifying parameters of said listening device according to a user's needs;

an impedance measuring circuit configured to measure an impedance of the speaker unit connected to the first communication interface; and a resistance measuring circuit configured to measure the resistance of the identification resistor, wherein the test device is configured to compare the impedance measured by the impedance measuring circuit against the resistance measured by the resistance measuring circuit and, to identify an error in the speaker module based on a result of the comparison.

2. A test device according to claim 1 comprising a measurement unit for performing a measurement contributing to a characterization of the speaker module.

3. A test device according to claim 1, further configured to identify a type of speaker unit based on the impedance measured by the impedance measuring circuit.

4. A test device according to claim 1 comprising a memory holding data characterizing a multitude of different speaker modules, and wherein the measurement unit is configured to characterize a currently electrically connected speaker module by comparison with data read from said memory.

5. A test device according to claim 1 comprising an indicator for indicating a result of said characterization of said speaker module.

6. A test device according to claim 1, wherein the first communication interface of the test device includes an electrical connector configured to match the electrical connector of the speaker module and allowing an electric connection to be established between the test device and the speaker module when said connectors are operationally connected.

7. A test device according to claim 1 comprising a data update facility for transferring data to a listening device.

8. A test system comprising a test device and a speaker module of a listening device, the speaker module including a speaker unit for converting an electric output signal to an output sound, an identification resistor, and an electrical connector configured to detachably connect to the listening device;

the test device including a housing separate from the speaker module and separate from the listening device, a first communication interface configured to electrically connect to the electrical connector of the speaker module, a second communication interface configured to connect to a programming device for modifying parameters of said listening device according to a user's needs, an impedance measuring circuit configured to measure an impedance of the speaker unit connected to the first communication interface, and a resistance measuring circuit configured to measure the resistance of the identification resistor, wherein the test device is configured to compare the impedance measured by the impedance measuring circuit against the resistance measured by the resistance measuring circuit and, to identify an error in the speaker module based on a result of the comparison.

9. A test system according to claim 8, wherein the electrical connector of the speaker module has a shape matching the shape of an electrical connector of the first communication interface of the test device and establishes an electric connection between the test device and the speaker module when the electrical connector of the speaker unit and the electrical connector of the test device are operationally connected.

10. A test system according to claim 8 wherein the measurement unit, or a programming device or fitting system operationally connected to the measurement unit, is configured to identify a type of speaker module from both measurements and to compare the results.

11. A test system according to claim 10, configured to identify possible errors in the speaker module based on said identifications of the type of speaker module and to present the result.

12. A test system, comprising:

a test device; and a listening device, wherein the test device includes a housing separate from a speaker module of the listening device and separate from the listening device, a test device (TD) electric connector configured to electrically connect to an electrical connector of the speaker module, a communication interface configured to connect to a programming device for modifying parameters of said listening device according to a user's needs, an impedance measuring circuit configured to measure an impedance of a speaker unit of the speaker module connected to the test device electric connector, and a resistance measuring circuit configured to measure resistance of an identification resistor of the speaker module, and the listening device includes the speaker module comprising a speaker module (SM) electric connector, and another module having another module (OM) electric connector, said SM- and OM-electric connectors are configured to allow electrical connection to be established between said speaker module and said other module of the listening device when said SM- and OM-connectors are operationally connected, and said TD- and SM-connectors are configured to allow electrical connection to be established between said test device and said speaker module when said TD- and SM-connectors are operationally connected, the test device comprises a TD-OM connector, configured to match an OM-TD connector, of the other module of the listening device and allowing an electrical connection to be established between the two modules when said connectors are operationally connected, and the test device is configured to compare the impedance measured by the impedance measuring circuit against the resistance measured by the resistance measuring circuit and, to identify an error in the speaker module based on a result of the comparison.

13. The test system according to claim 12, wherein the test device comprises an evaluation unit for evaluating an electric output signal of the other part of the listening device, the electric output signal comprising audio for being transferred to the speaker module during normal operation of the listening device.

14. The test system according to claim 13, wherein the evaluation unit is configured to decide whether the electric output signal from the other module is erroneous or OK.

15. The test system according to claim 12, wherein the listening device is configured to provide a test signal resulting in said electric output signal of the other part of the listening device.

16. The test system according to claim 12, further comprising:

a data update facility for transferring data to the listening device.

17. The test system according to claim 16, wherein said data update facility for transferring data to the listening device is configured to transfer data selected from the group comprising processing algorithms that define a particular type or model of the listening device, versions of processing algorithms having different features, and user specific data.

18. A test device according to claim 3, further configured to identify a type of speaker unit based on the resistance measured by the resistance measuring circuit.

19. A test device according to claim 18, wherein the test device is configured to identify the error in the speaker module when the type of the speaker unit identified based on the resistance differs from the type of the speaker unit identified based on the measured impedance.

20. A test device according to claim 1, wherein the listening device is a hearing aid.

21. A test system according to claim 8, wherein the listening device is a hearing aid.

22. A test system according to claim 12, wherein the listening device is a hearing aid.

* * * * *